US008644530B2

(12) United States Patent
Soininen et al.

(10) Patent No.: US 8,644,530 B2
(45) Date of Patent: Feb. 4, 2014

(54) DUST PROTECTION OF SOUND TRANSDUCER

(75) Inventors: Toni O. Soininen, Oulu (FI); Petri A. Soronen, Oulu (FI); Heikki J. Huttunen, Haukipudas (FI); Marko H. Kelloniemi, Kempele (FI)

(73) Assignee: Nokia Corporation, Espoo (FI)

( * ) Notice: Subject to any disclaimer, the term of this patent is extended or adjusted under 35 U.S.C. 154(b) by 155 days.

(21) Appl. No.: 13/248,189

(22) Filed: Sep. 29, 2011

(65) Prior Publication Data

US 2013/0083957 A1 Apr. 4, 2013

(51) Int. Cl.
*H04R 25/00* (2006.01)
*H04R 1/00* (2006.01)

(52) U.S. Cl.
USPC ..... 381/189; 381/396

(58) Field of Classification Search
USPC ..... 381/189, 325, 386, 391, 396; 455/575.1
See application file for complete search history.

(56) References Cited

U.S. PATENT DOCUMENTS

| | | | | |
|---|---|---|---|---|
| 2,256,689 | A | 6/1937 | Quam | 179/115.5 |
| 4,972,488 | A | 11/1990 | Weiss et al. | 381/68.6 |
| 5,909,015 | A | 6/1999 | Yamamoto et al. | 181/156 |
| 2004/0060358 | A1 * | 4/2004 | Datskos | 73/655 |
| 2006/0198547 | A1 | 9/2006 | Hampton et al. | 381/395 |
| 2008/0203560 | A1 | 8/2008 | Suzuki | 257/723 |
| 2009/0230487 | A1 * | 9/2009 | Saitoh et al. | 257/419 |

FOREIGN PATENT DOCUMENTS

| | | | |
|---|---|---|---|
| CN | 201042078 | Y | 3/2008 |
| CN | 101426166 | A | 8/2008 |
| CN | 201160322 | Y | 12/2008 |
| EP | 1427250 | A2 | 6/2004 |
| EP | 1921891 | A2 | 5/2008 |
| JP | 2008005423 | A | 1/2008 |
| JP | 2010057052 | A | 3/2010 |
| JP | 2010268412 | A | 11/2010 |
| WO | WO-2010148406 | A1 | 12/2010 |
| WO | WO-2011/015236 | A1 | 2/2011 |

* cited by examiner

*Primary Examiner* — Fan Tsang
*Assistant Examiner* — Eugene Zhao
(74) *Attorney, Agent, or Firm* — Harrington & Smith

(57) ABSTRACT

An apparatus including a housing having a sound hole; a sound transducer in the housing; and a dust barrier in the housing between the sound hole and the sound transducer. The dust barrier has a deck located in a path between the sound hole and the sound transducer. The deck comprises a dust collection pocket configured to accumulate dust therein and prevent dust from passing through the deck at the dust collection pocket. A sound aperture is provided between the sound hole and the sound transducer such that sound passes by the dust collection pocket between the sound hole and the sound transducer.

30 Claims, 9 Drawing Sheets

DUST PROTECTION OF SOUND TRANSDUCER

BACKGROUND

1. Technical Field

The exemplary and non-limiting embodiments relate generally to protecting a sound transducer and, more particularly, to protecting the sound transducer from particulates.

2. Brief Description of Prior Developments

Devices, such as mobile phones for example, use a dynamic speaker and/or receiver (microphone) to receive and reproduce audio signal such as speech, music and alerting tones to a user. Such speakers/receivers are widely used in telecommunications, but also in automobile, military, medical and consumer electronics. A dynamic speaker/receiver has an internal membrane and magnet system that are vulnerable to external particles such as dust, metal particles, sand, etc.; generally identified as dust herein. The magnet system attracts metal particles which can penetrate the speaker/receiver. Metal particles are very common in many work places; especially in developing countries. It is also common to have metal particles in a pocket of trousers where keys have rubbed against each other producing metal dust.

External particle(s) entering the membrane and/or the magnet system of the speaker/receiver will deteriorate the performance of the speaker/receiver and reduce the sound quality by lowering loudness and introducing distortion until the speaker/receiver unit will totally fail.

External particle(s) at the membrane increase the force needed to move the membrane through added mass (like sand, cotton, metals, etc.) and through magnet field attraction force (ferromagnetic and ferrimagnetic instances like iron, nickel, manganese and compounds of those). This can lower the acoustic output of the speaker/receiver and introduce distortion as the EMF-motor of the speaker/receiver does not have resources to move the added mass properly; because they are designed to work only with their own mass. Especially, ferromagnetic and ferrimagnetic instances are very harmful.

External particle(s) at the membrane can cause distortion as the membrane moves due to the membrane movement; the particles bouncing back and forth inside the speaker/earpiece and hitting the membrane and other structures next to the membrane. This extra sound from impacts can be perceived as unwanted additional sound i.e. distortion. External particle (s) at the magnet system can cause rub and buzz type of distortion as the particles are hitting and scratching the moving voice coil and magnet of the speaker/receiver. This extra sound from hitting and scratching can be perceived as unwanted additional sound i.e. distortion.

SUMMARY

The following summary is merely intended to be exemplary. The summary is not intended to limit the scope of the claims.

In accordance with one example embodiment, an apparatus is provided comprising a housing having a sound hole; a sound transducer in the housing; and a dust barrier in the housing between the sound hole and the sound transducer. The dust barrier comprises a deck located in a path between the sound hole and the sound transducer. The deck comprises a dust collection pocket configured to accumulate dust therein and prevent dust from passing through the deck at the dust collection pocket. A sound aperture is provided between the sound hole and the sound transducer such that sound passes by the dust collection pocket between the sound hole and the sound transducer.

In accordance with another example embodiment, an apparatus is provided comprising a housing having a sound hole; a sound transducer in the housing, where the sound transducer comprises a permanent magnet; and a magnetic dust collection system for collecting dust which enters the sound hole and preventing the dust from reaching the sound transducer. The magnetic duct collection system comprises a dust barrier between the sound hole and the permanent magnet and a magnetic field of the permanent magnet being orientated across a sound aperture, formed by the housing and the dust barrier, to magnetically pull dust against the dust barrier.

In accordance with another example, a method comprises connecting a dust barrier to a housing of an apparatus, where the housing comprises a sound hole through the housing, where the dust barrier comprises a dust collection pocket to capture dust entering the housing through the sound hole; and locating a sound transducer inside the housing, where the dust barrier is located in a path between the sound hole and the sound transducer, where the dust barrier is configured to accumulate dust therein and prevent dust from passing through the deck at the dust collection pocket, where a sound aperture is formed between the sound hole and the sound transducer such that sound passes by the dust collection pocket between the sound hole and the sound transducer

BRIEF DESCRIPTION OF THE DRAWINGS

The foregoing aspects and other features are explained in the following description, taken in connection with the accompanying drawings, wherein.

DETAILED DESCRIPTION OF EMBODIMENTS

Figure 1:
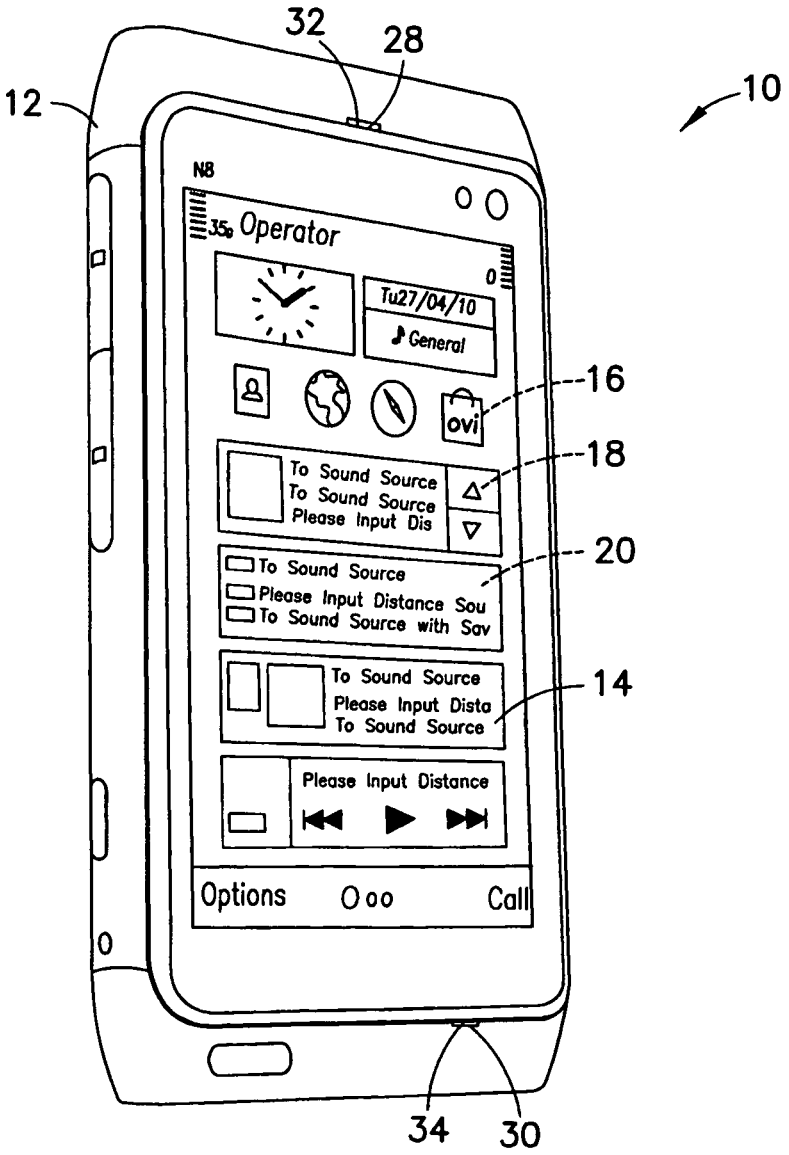
FIG. 1 is a perspective view of an apparatus comprising features of an example embodiment.

Referring to FIG. 1, there is shown a perspective view of an apparatus 10 incorporating features of an example embodiment. Although the features will be described with reference to the example embodiments shown in the drawings, it should be understood that features can be embodied in many alternate forms of embodiments. In addition, any suitable size, shape or type of elements or materials could be used.

Figure 2:
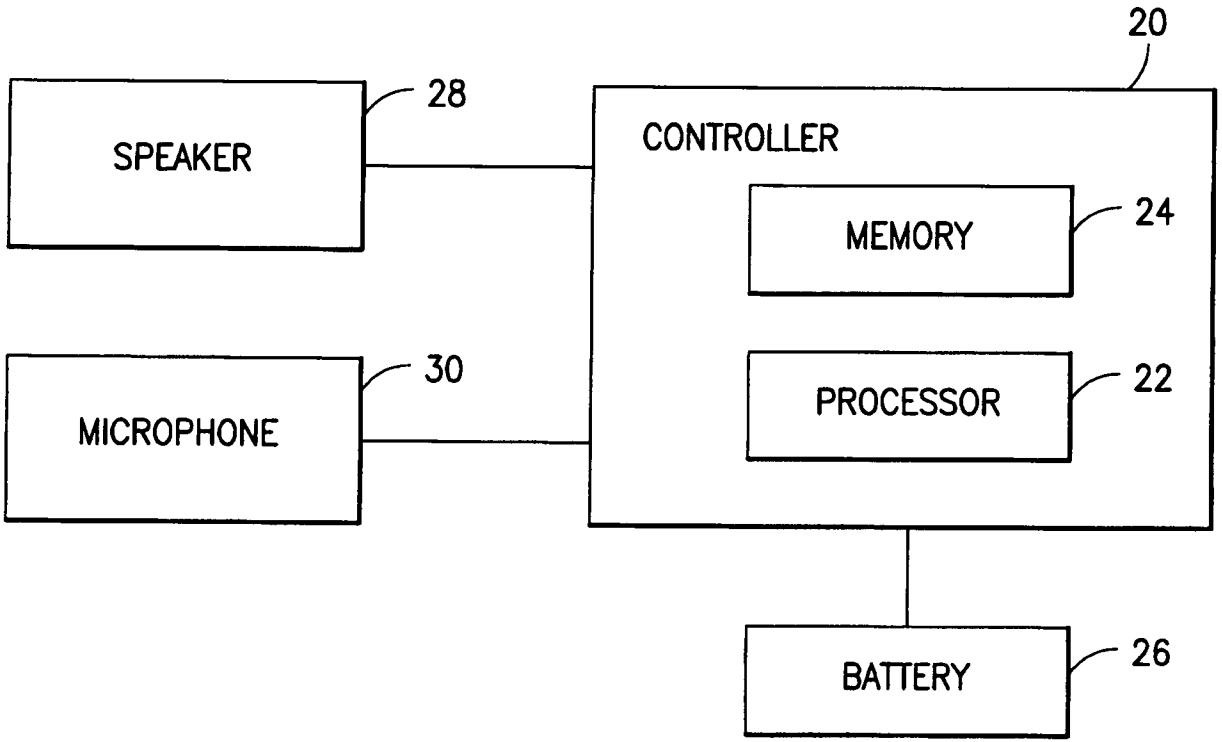
FIG. 2 is a diagram illustrating some of the components in the apparatus shown in FIG. 1.

The apparatus 10 in this example is a hand-held portable electronic device comprising a telephone application, Internet browser application, camera application, video recorder application, music player and recorder application, email application, navigation application, gaming application, and/or any other suitable electronic device application. The apparatus 10, in this example embodiment, comprises a housing 12, a touch screen 14 which functions as both a display and a user input, a receiver 16, a transmitter 18, a controller 20 which can include (referring also to FIG. 2) at least one processor 22, at least one memory 24, software, and a rechargeable battery 26. However, these features are not necessary to implement the protection described below. For example, a touch screen or additionally a conventional keypad or other user input could be used. Thus, features could be used in any suitable type of device, such as a telephone only for example.

The apparatus 10 also includes a speaker 28 and a microphone 30 which each comprise a sound transducer. The housing 12 comprises at least one sound hole 32 for sound to travel from the speaker 28 and at least one sound hole 34 for sound to travel to the microphone. The description which follows will be in regard to the area at the speaker 28. However, the features described are equally applicable to the area at the microphone 30. Features of the invention could be used at the speaker 28 and/or at the microphone 30.

Figure 3:
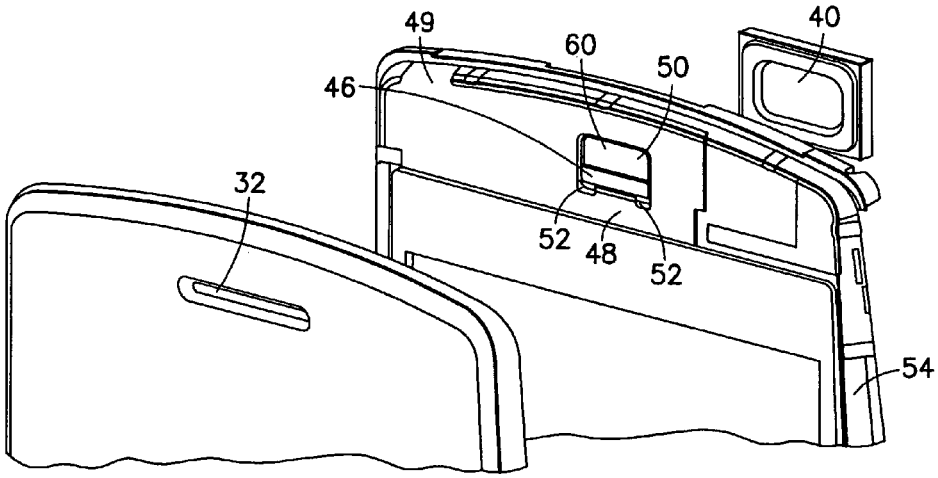
FIG. 3 is a partial exploded perspective view of some of the components of the apparatus shown in FIG. 3.
Figure 4:
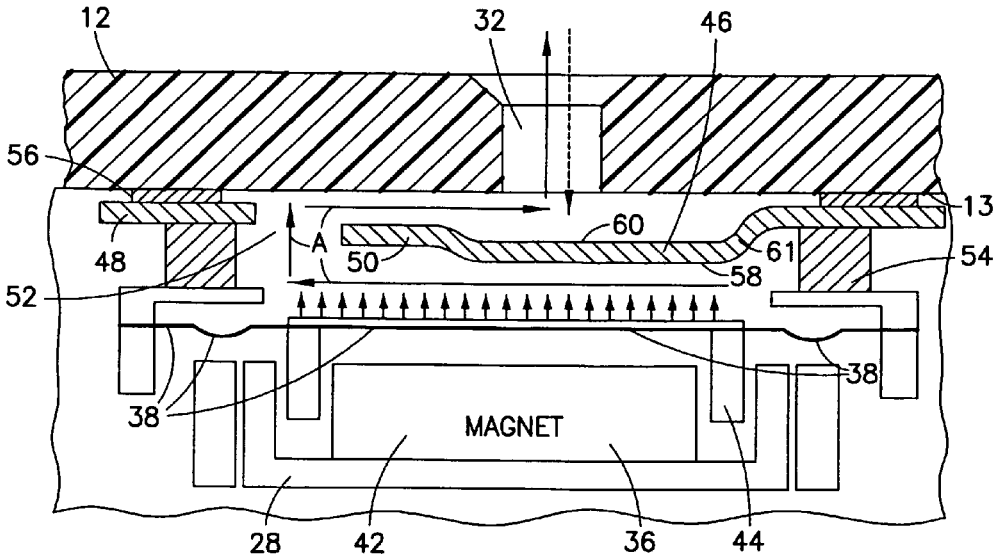
FIG. 4 is a schematic cross sectional view illustrating the components shown in FIG. 3.

Referring also to FIGS. 3 and 4, the speaker 28 includes a sound transducer 36 with a membrane 38 provided as a subassembly 40 in this example. The sound transducer 36 includes a permanent magnet 42 and a coil 44 attached to the membrane 38. The apparatus 10 comprises a system for protecting the speaker 28 from dust. As noted above, this is alternatively or additionally applicable to the microphone. The protection system in this example comprises a dust barrier 46. The protection system in this example also comprises a magnetic dust collection system.

In the example embodiment shown, the dust barrier 46 is a substantially solid member which is located between the speaker 28 and the inner side of the housing 12. Because the dust barrier is solid, it is non-porous for dust particles or air to travel through its walls. The dust barrier may comprise substantially rigid metal or plastic material, for example, and comprises an outer portion 48, an inner portion 50 and at least one sound opening 52. The outer portion 48 is sandwiched between a portion of the speaker 28 and the inner side surface of the housing 12 around the sound hole 32. As seen in FIG. 3, at least a section 49 of the outer portion may extend to another location; perhaps to perform an additional function. The dust barrier 46 is shown on a frame member 54 of the housing 12 in this example assembled as a subassembly with the frame member 54. Vibration dampening material or gasket 56 may be provided directly between the dust barrier 46 and the inner side 13 of the front cover of the housing 12.

The dust barrier 46 comprises a deck 58 at the inner portion 50 which comprises a recessed dust collection pocket or dust pool 60. The pocket 60 is located behind the sound hole 32, directly in a path between the sound hole 32 and the sound transducer 36. As seen best in FIG. 3, in this example embodiment the deck 58 has two of the sound openings 52. However, in an alternate embodiment only one sound opening through the deck might be provided; or more than two sound openings could be provided. As noted above, the deck 58 is located in the direct path between the sound hole 32 and the sound transducer 36. The sound openings 52 are offset from the direct path between the sound hole 32 and the sound transducer 36. Thus, as illustrated by arrows A, a tortuous sound aperture is provided from the sound transducer 36 to the sound hole 32. Sound generated from movement of the membrane 38 travels as indicated by arrows A crossways along an area between the membrane 38 and the back side of the deck 58, through the offset sound openings 52 in the deck, crossways along an area between the front side of the deck and the inner side 13 of the housing cover, and finally out the sound hole 32. The sound channel is much larger than any dust particles, and provides a substantially open and unobstructed (albeit somewhat tortuous) sound transmission aperture. The sound openings 52 in deck 58 in the embodiment of FIGS. 3 and 4 are located into the offset places also because the magnet field strength towards the magnet is not as high as it is in the dust pool 60 area.

Figure 5:
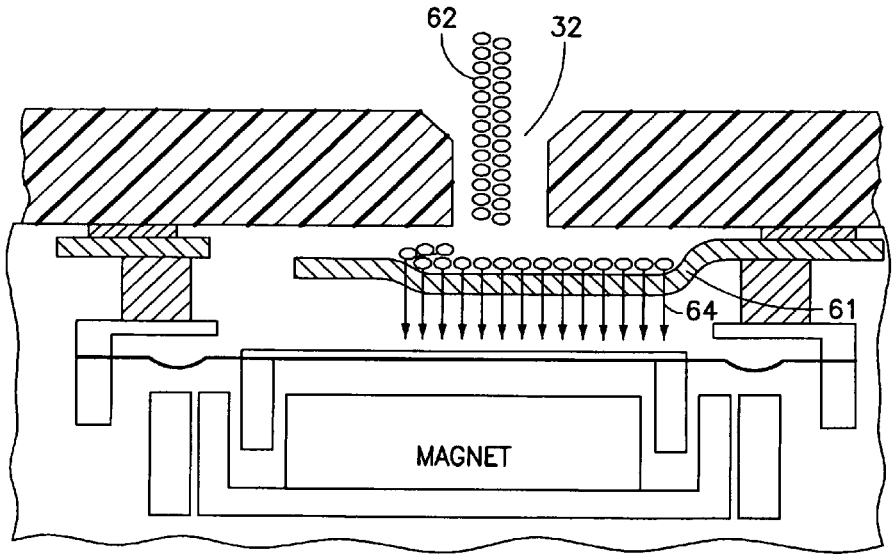
FIG. 5 is a schematic cross sectional view similar to FIG. 4 illustrating capture of dust.

Referring also to FIG. 5, because the sound hole 32 is substantially open, dust 62 can enter into the apparatus through the sound hole 32. As noted above, the term "dust" as used herein is intended to describe small particles which could include sand, dirt, dander or metal particles for example. The pocket 60 is much larger than the individual dust so it can hold a relatively large quantity of the dust in the pocket. The pocket 60 provides an area where the dust can be caught such that it does not travel to the sound transducer. In other words, the physical shape of the pocket 60, its location relative to the sound hole 32 and transducer 36, and the shape of the sound aperture through the sound openings 52 between the sound hole 32 and the sound transducer 36, provide a mechanical catch or pool effect of the dust in the pocket 60.

As noted above, the protection system also comprises a second feature; namely, a magnetic dust collection system. The magnetic dust collection system uses the dust barrier 46 in conjunction with the magnetic pull 64 generated by the magnetic field of the permanent magnet 42 to magnetically pull the dust 62, after it enters the sound hole 32, against the front side of dust barrier 46 such that the dust does not reach the sound transducer 36. As noted above the mechanical dust pool feature could be used without a magnetic dust collection system. Likewise, a magnetic dust collection system could be used with a dust barrier which does not have a recessed pocket. The harmful dust particles having been pulled to the pool 60, the barrier 46 and the magnetic pull 64 prevent them from slipping off from the pool to the membrane 38 during impact forces caused by dropping the phone, etc.

With an example embodiment a dust barrier is formed by introducing a metal or plastic (or other material) deck right after the sound hole. If this barrier is also formed as a pool shape having edge walls 61 surrounding the pool, then a 'Dust Pool' is formed. FIGS. 4-5 present this construction with the component (speaker or receiver) at the bottom and device mechanical structures above.

An example embodiment can prevent external particles from entering the vulnerable areas of the speaker/receiver:

- By using a shaped sound channel that includes a 'Dust Barrier' having a 'Dust Pool'; and
- By utilization of the internal magnet of speaker/receiver to hold the most problematic ferromagnetic and ferromagnetic instances.

An example embodiment can enable virtually total protection against external ferromagnetic and ferrimagnetic particles and, thus, the lifetime of the component will be significantly longer. An example embodiment will not affect the acoustic output and, thus, it:

- can be used without reducing the acoustic output power and loudness; and can be used without introducing any unwanted sounds that will be perceived as distortion by the user.

An example embodiment can allow getting rid of one part such as mesh/cloth/membrane, thus reducing the cost and thickness. Earlier solutions are mainly based on the dust protection mesh, cloth or membrane. These solutions are widely visible for example in any mobile phone or headphone at the market. Some more advanced combine mesh/cloth/membrane with a long or sideways leading sound channel. However, woven dust protection mesh will have finite open area. It means there are lots of small threads crossing each other and there will be apertures between the threads. These apertures are also needed to let air flow through the member. Without adequate air flow there will be attenuation of sound level (because of high acoustic resistance) and also distortion caused by turbulence at very extreme. These apertures make it possible that external particles of smaller size than the aperture size will penetrate through the member. Also, meshes will eventually clog with dust. This will block air flow.

Cloths are similar to woven meshes, but threads are smaller and irregular in size and also the apertures have irregular shape. Threads and apertures form a tight network of tubes and cavities that are open in both ends. However, the problem with such cloths is that they will be blocked very easily with dust. They also have limited protection efficiency versus acoustic resistance characteristic like meshes.

Membranes are able to be manufactured totally hermetic (i.e. no air flow through the membrane with pressures relevant to system). Membranes can block all dust entering the speaker/receiver. However, a membrane will act as passive radiator. A passive radiator will transfer the acoustic energy at one side of the radiator to mechanical movement, and again mechanical movement is transferred back to acoustic energy at the other side of radiator. A membrane as a passive radiator will move with the moving air in a non-linear fashion and, if not controlled, can move in a totally unpredictable manner. It will introduce losses and, thus, reduction of acoustic output and loudness. It has non-linearities, especially high non-linearities at high volume velocity and, thus, it will alter the sound and cause distortion.

Long or sideways leading sound channel make the path for the external particle to reach the vulnerable areas of the speaker/receiver longer. In some cases it also reduces the effect of internal magnet attraction forces.

Mechanical impacts tend to shake the dust inside to enable it more efficiently penetrate to the above mentioned vulnerable areas. An example embodiment with at least some of the features described above can prevent the dust from entering the membrane and/or magnet system, perhaps up to 100 percent under several stress conditions, including excess dust and mechanical impacts.

An example embodiment with at least some of the features described above can introduce a conscious design and shaping of the sound channel in a way that it prevents the external particles from reaching the speaker/receiver and, thus, makes it impossible for the particles to harm the performance and quality of the sound transducer. Additionally, an example embodiment can have a 'Dust Barrier' that stops dust and a 'Dust Pool' that stores the dust.

An example embodiment with at least some of the features described above can provide protection against harmful ferromagnetic and ferrimagnetic instances by shaping the channel, so that the path from the outer world all the way to the speaker/receiver vulnerable areas will pass through the magnet field caused by the internal magnet. Together with the internal magnet, particles can be blocked and their movement restricted to a safe area, such as the 'Dust Pool'.

An example embodiment with at least some of the features described above can be provided without having to have any significant effect on sound level or sound quality.

Figure 6:
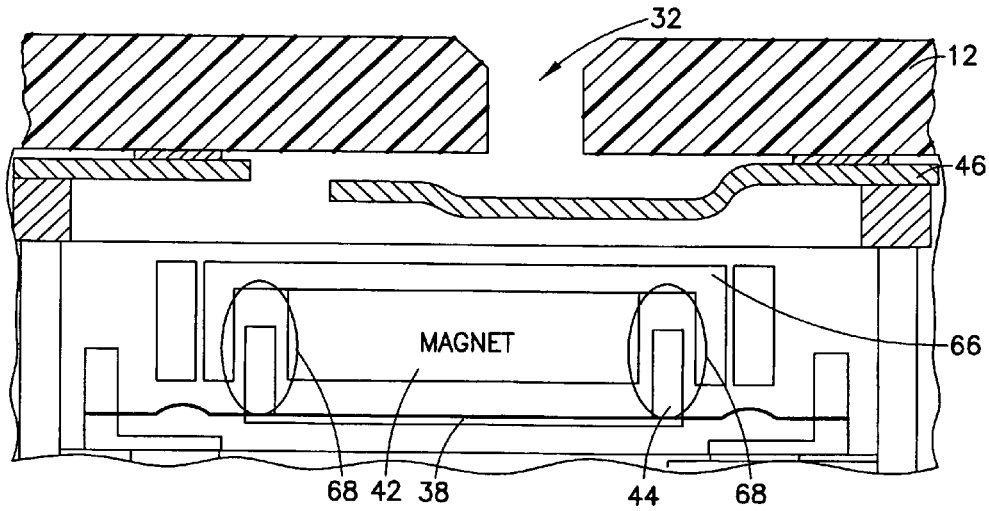
FIG. 6 is a schematic cross sectional view of an alternate example embodiment similar to FIG. 4.

Referring also to FIG. 6, an alternate example embodiment similar to FIG. 4 is shown which presents an alternative design path. In this design the component (sound transducer) 36 is reversed and now the vulnerable areas 68 are in the magnet cap rather than previously at the membrane area of FIG. 4. In the magnet cap 66 there is the moving voice coil. If some particles are in the magnet cap at 68, then particles can rub against the voice coil 44 and produce audible distortion. Reduction in level can be seen when there is adequate amount of dust that it reduces the free space of membrane movement. Providing the dust barrier 46 can prevent this audible distortion and reduction in level.

Figure 7:
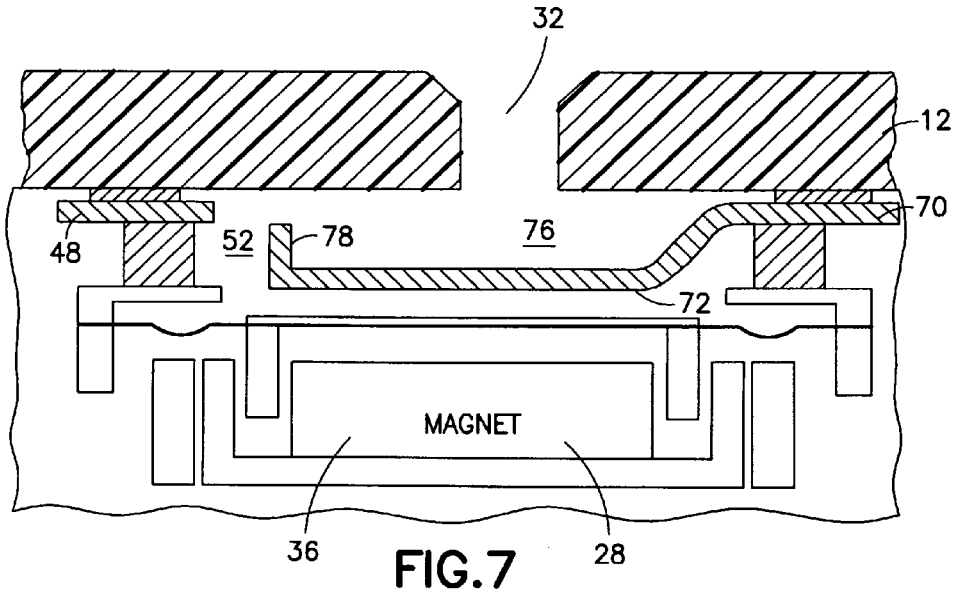
FIG. 7 is a schematic cross sectional view of another alternate example embodiment similar to FIG. 4.

FIG. 7 illustrates an alternate example embodiment similar to FIG. 4. In this embodiment the dust barrier 70 may comprise substantially rigid metal or plastic material, for example, and comprises an outer portion 48, an inner portion 72 and at least one sound opening 52. The outer portion 48 is sandwiched between a portion of the speaker 28 and the inner side surface of the housing 12 around the sound hole 32. The dust barrier 70 comprises a deck 74 at the inner portion 72 which comprises a recessed dust collection pocket or dust pool 76. The pocket 76 is located behind the sound hole 32, directly in a path between the sound hole 32 and the sound transducer 36. In this example embodiment the deck 74 has only one sound opening 52. However, in an alternate embodiment more than one sound opening might be provided. The sound opening 52 is offset from the direct path between the sound hole 32 and the sound transducer 36. The wall 78 of the deck 74 between the pocket 76 and the sound opening 52 has a sharp turn or angle relative to the bottom wall of the pocket. This presents a more effective alternative shape to keeping dust inside the pocket 76 such that it does not travel past the wall 78.

Figure 8:
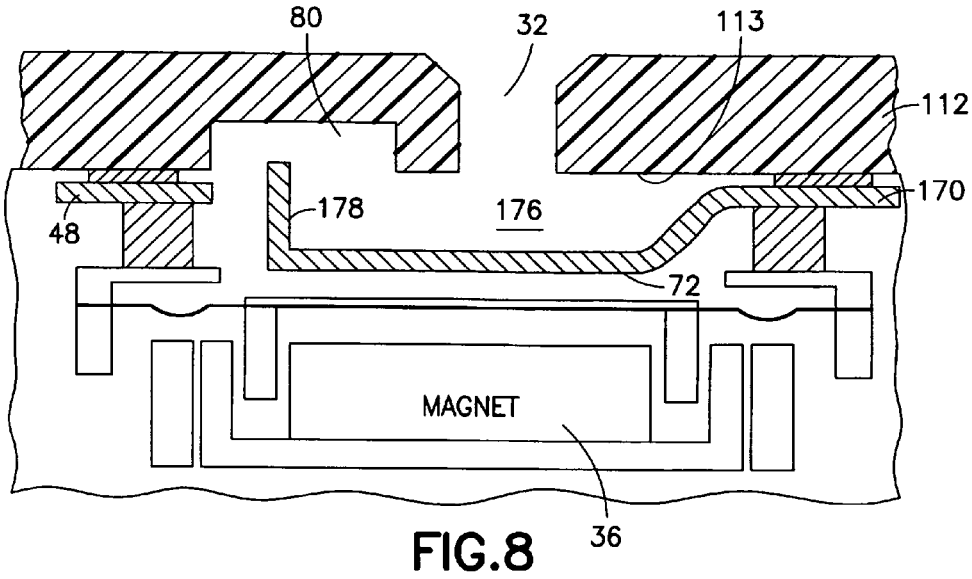
FIG. 8 is a schematic cross sectional view of another alternate example embodiment similar to FIG. 7.

FIG. 8 illustrates an alternate example embodiment similar to FIG. 7. In this example embodiment the inner surface 113 of the cover of the housing 112 has a recess 80. The wall 178 of the dust barrier 170 extends past the outer portion 48 into the recess 80. This establishes a more tortuous sound aperture between the sound hole 32 and the sound transducer 36, and a larger dust pool. Thus, dust is less likely to be able to get from the sound hole 32 to the sound transducer. This illustrates an even more effective dust protection alternative system where the similar type 'Dust Barrier' has more extreme shape.

Figure 9:
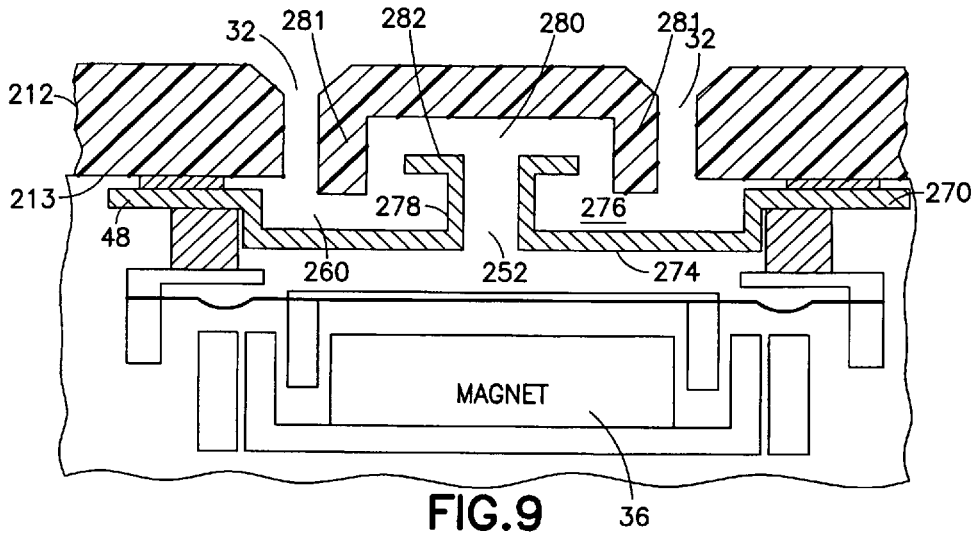
FIG. 9 is a schematic cross sectional view of another alternate example embodiment similar to FIG. 8.

FIG. 9 illustrates an alternate example embodiment similar to FIG. 8. In this example embodiment the inner surface 213 of the cover of the housing 212 has a recess 280 which is located between at least two sound holes 32. The recess 280 has longer side walls 281. The dust barrier 270 has a deck 274 forming a recessed pocket or dust pool 276. A sound opening 252 is provided through the deck 274 in a general middle section of the deck. A wall 278 of the deck surrounds and forms the sound opening 252 and a wall of the dust pool 276. A top end 282 of the wall 278 extends past the outer portion 48 and into the recess 280. The top end 282 has an extending lip shape to form an even more tortuous sound aperture between the sound holes 32 and the sound transducer 36. This example embodiment illustrates an alternative 'Dust Pool' with a multiple sound holes configuration. There is also an additional horizontal 'Dust Barrier', which again adds for more protection against impacts of dropping where the particles are possibly moving in the pool.

Figure 10:
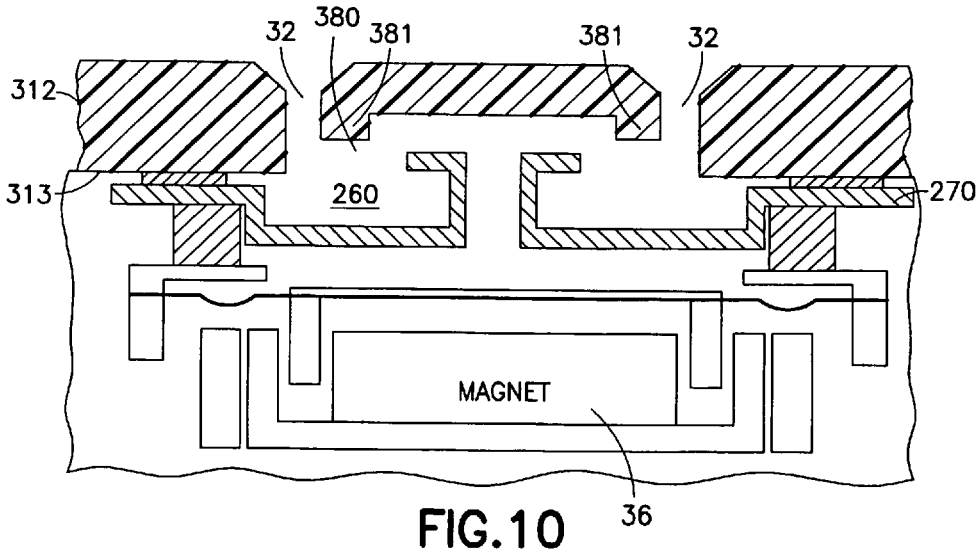
FIG. 10 is a schematic cross sectional view of another alternate example embodiment similar to FIG. 9.

FIG. 10 illustrates an alternate example embodiment similar to FIG. 9. In this example embodiment the inner surface 313 of the cover of the housing 312 has a recess 380 which is located between at least two sound holes 32. The recess 380 has shallower side walls 381. The dust barrier 270 is the same. This example embodiment illustrates an alternative 'Dust Pool' with two sound holes configuration and with a shorter acoustic path, which leads to optimized acoustic performance.

An example embodiment may comprise an apparatus comprising a housing 12 comprising a sound hole 32, 34; a sound transducer 36 in the housing; and a dust barrier 46 in the housing between the sound hole and the sound transducer, where the dust barrier comprises a substantially solid deck 58 located in a path directly between the sound hole and the sound transducer, where the deck comprises a recessed dust collection pocket 60 behind the sound hole, and where the deck comprises a sound opening 52 therethrough which is offset from the path to form a tortuous sound aperture between the sound hole and the sound transducer.

The recessed dust collection pocket 60 may be in the path and directly behind the sound hole. The sound opening may be the sole sound opening through the deck. A portion of the deck, which forms a portion of the pocket, may be located in a recess 80 into an inner side of the housing. The deck may comprises an outer portion 48 connected to an inner side of the housing and an inner portion 50, where the inner portion forms a portion of the pocket and extends towards the housing past the outer portion. The housing may comprise multiple ones of the sound hole 32, where the sound opening 252 in the deck is in an area generally between the sound holes. The sound opening 52 may be in a middle area of the deck. The pocket may comprise at least one pocket 260 on opposite sides of the sound opening. The deck may comprise an outer portion connected to an inner side of the housing and an inner portion which extends towards the housing past the outer portion, where the inner portion of the deck is located in a recess into an inner side of the housing. The apparatus may further comprise means for magnetically attracting dust into the pocket.

An example embodiment may comprise an apparatus 10 comprising a housing comprising a sound hole 32; a sound transducer 36 in the housing, where the sound transducer comprises a permanent magnet 42; and a magnetic dust collection system for collecting dust which enters the sound hole and preventing the dust from reaching the sound transducer, where the magnetic dust collection system comprises a dust barrier 46 between the sound hole and the permanent magnet and a magnetic field of the permanent magnet being orientated across a sound channel, formed by the housing and the dust barrier, to magnetically pull dust against the dust barrier.

The dust barrier may comprise a substantially solid deck located in a path directly between the sound hole and the sound transducer. The dust barrier may comprise a recessed dust collection pocket directly behind the sound hole. The deck may comprise a sound opening therethrough which is offset from the path to form a tortuous sound channel between the sound hole and the sound transducer. The sound opening may be the sole sound opening through the deck. A portion of the dust barrier may be located in a recess into an inner side of the housing. The dust barrier may comprise an outer portion connected to an inner side of the housing and an inner portion which extends towards the inner side of the housing past the outer portion. The housing may comprise multiple ones of the sound holes, where at least one sound opening in the dust barrier is in an area generally between the sound holes. The dust barrier may have a sound opening therethrough which is in a middle area of the dust barrier.

Figure 11:
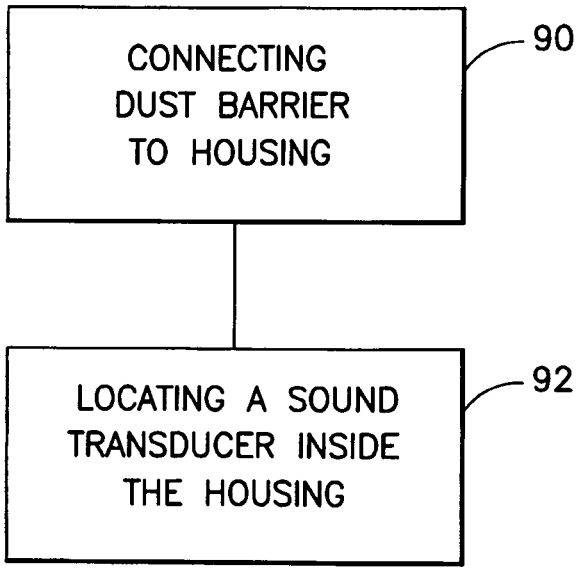
FIG. 11 is a block diagram illustrating a method.

Referring also to FIG. 11, an example method may comprise connecting a dust barrier to a housing of an apparatus as illustrated by block 90, where the housing comprises a sound hole through the housing, where the dust barrier comprises a recessed depression behind the sound hole to capture dust entering the housing through the sound hole; and locating a sound transducer inside the housing as illustrated by block 92, where the dust barrier is located between the sound hole and the sound transducer, where the dust barrier is substantially solid and has a sound opening therethrough which is offset from a path directly between the sound hole and the sound transducer to form a tortuous sound channel between the sound hole and the sound transducer.

Figure 12:
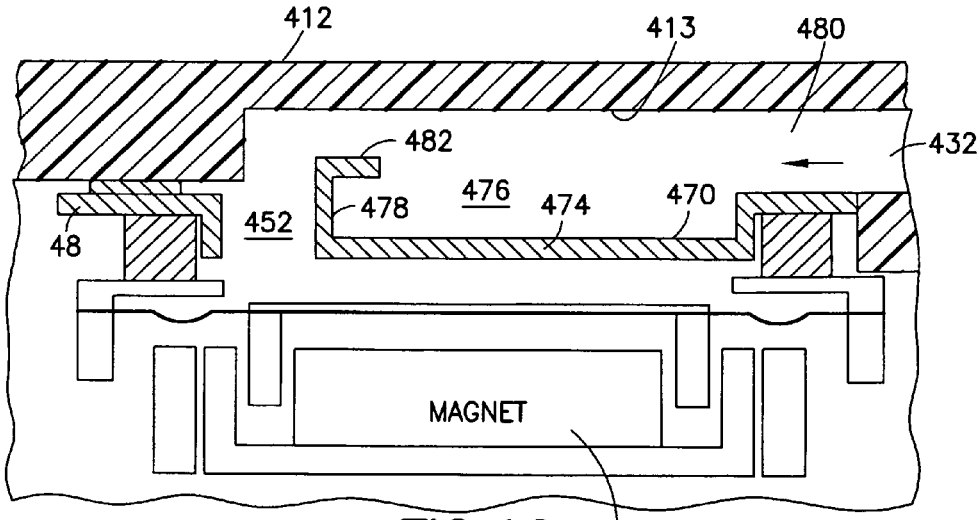
FIG. 12 is a schematic cross sectional view of another alternate example embodiment similar to FIG. 9.

FIG. 12 illustrates an alternate example embodiment similar to FIG. 9. In this example embodiment the inner surface 413 of the cover of the housing 412 has a recess 480 which forms a sound hole 432 towards a side of the device. The dust barrier 470 has a deck 474 forming a recessed pocket or dust pool 476. A sound opening 452 is provided through the deck 474. A wall 478 of the deck forms a side of the sound opening 452 and a wall of the dust pool 476. A top end 482 of the wall 478 extends past the outer portion 48 and into the recess 480. The top end 482 has an extending lip shape to form an end of the pocket. This example embodiment illustrates an alternative 'Dust Pool' with a side firing embodiment. Side firing designs are common in mobile phone integrations.

Figure 13:
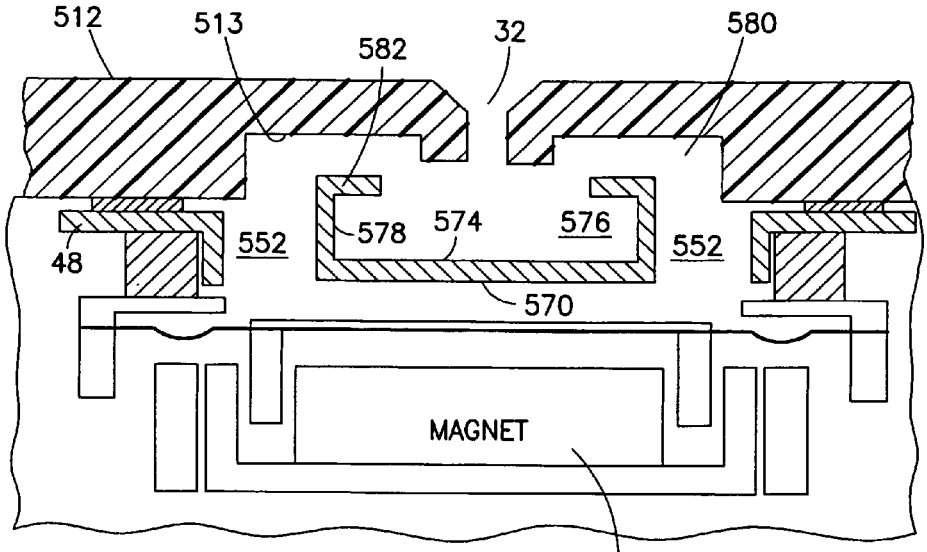
FIG. 13 is a schematic cross sectional view of another alternate example embodiment similar to FIG. 9.

FIG. 13 illustrates an alternate example embodiment similar to FIG. 9. In this example embodiment the inner surface 513 of the cover of the housing 512 has a recess 580 and a sound hole 32. The dust barrier 570 has a deck 574 forming a recessed pocket or dust pool 576. Sound openings 552 are provided through the deck 574. A wall 578 of the deck forms a side of the sound openings 552 and a wall of the dust pool 576. A top end 582 of the wall 578 extends past the outer portion 48 and into the recess 580. The top end 582 has an extending lip shape to form an end of the pocket. This example embodiment illustrates an alternative 'Dust Pool' which is at the center of two openings 552 through the dust barrier above the speaker.

Figure 14:
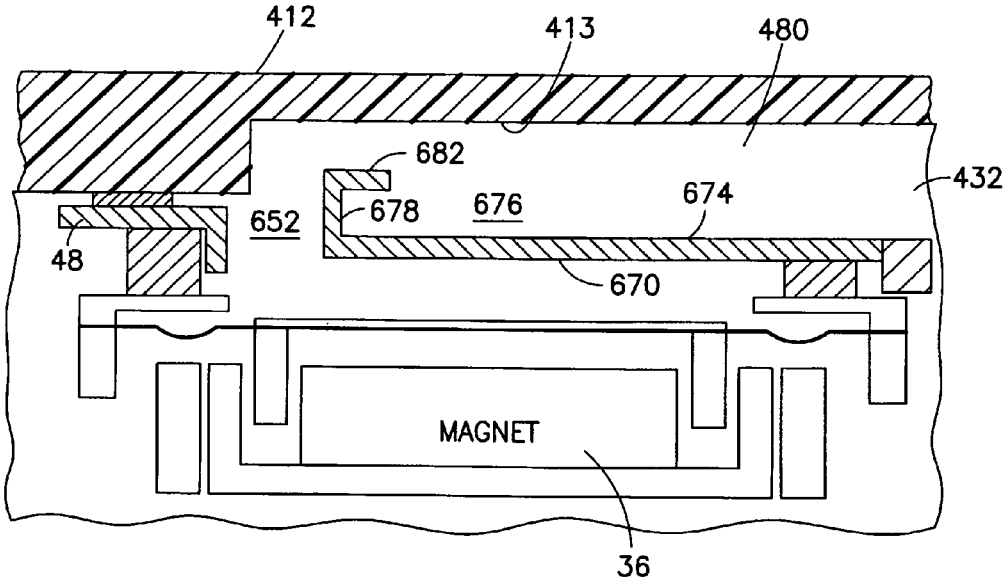
FIG. 14 is a schematic cross sectional view of another alternate example embodiment similar to FIG. 12.

FIG. 14 illustrates an alternate example embodiment similar to FIG. 12. In this example embodiment the inner surface 413 of the cover of the housing 412 has a recess 480 which forms a sound hole 432 towards a side of the device. The dust barrier 670 has a deck 674 forming a pocket or dust pool 676 which is not recessed. A sound opening 652 is provided through the deck 674. A wall 678 of the deck forms a side of the sound opening 652 and a wall of the dust pool 676. A top end 682 of the wall 678 extends past the outer portion 48 and into the recess 680. The top end 682 has an extending lip shape to form an end of the pocket. This example embodiment illustrates an alternative 'Dust Pool' with a side firing embodiment.

Features described above can be provided for all type of sound transmitting or receiving transducers such as, for example, earpieces, multi-function-device (effectively a multi-function-device is a speaker component that is acting as a hands-free speaker, earpiece and vibra in low end products) as well as microphones, and hand-free speakers. For all these examples, the features described above can be provided without having to have any significant effect on sound level or sound quality.

The deck could be designed as part of an A-cover (display window) or bezel or mesh or grill wherein at least one sound aperture is designed. In this embodiment, the sound hole and the dust barrier could be a single component where the user (or service point) can possibly remove it and clean the dust.

The deck may be designed under the sound hole or anywhere within the internal cavity in such a way that the internal cavity acoustically (and/or mechanically) couples with the sound hole. It may be that deck itself does not comprise any sound openings, but the deck forms such opening(s) as part of the sound aperture/channel between the sound hole and the sound transducer around or at an outer portion of the deck. In technical terms, the deck may be formed in a way so that such aperture around the deck is classified as a cavity (air volume). Inside the cavity, there may not be any sound channel/aperture. Such air volume/cavity may be coupled with the sound hole to form a Helmholtz resonator.

Past dust protection solutions such as mesh, cloth, grill, etc. were not effective for dust collection because such dust particles still passed through. They are acoustically transparent, and do not have any recessed deck structure. They act as a resistive load to sound waves, therefore, such dust is never being collected at a local point. Past dust protection solutions will have less chance to stop water, whereas features described herein can locate water more successfully and prevent the water from access to the sound transducer. Features of an example embodiment design can have a mesh, cloth, etc. in addition to a deck structure as described herein.

The recessed dust collection pocket may be substantially acoustically not transparent which would indicate that the sound waves will not pass through because the deck assists in guiding the sound waves through the sound opening, but nonetheless traps dust. Such deck structure could be designed in such a way that there is no tortuous sound channel, but such channel could be rather classified as an aperture or leakage conduit.

An example embodiment may be provided as an apparatus comprising a housing having a sound hole; a sound transducer in the housing; and a dust barrier in the housing between the sound hole and the sound transducer. The dust barrier comprises a deck located in a path between the sound hole and the sound transducer. The deck comprises a recessed dust collection pocket configured to accumulate dust therein and prevent dust from passing through the deck at the recessed dust collection pocket. A sound aperture is provided between the sound hole and the sound transducer such that sound passes by the dust collection pocket between the sound hole and the sound transducer.

The deck may form a sound opening between the sound hole and the sound transducer which is offset from the path to form a tortuous sound aperture between the sound hole and the sound transducer. The deck may form a sound opening between the sound hole and the sound transducer, where the deck is substantially solid such that sound does not substantially pass through the deck except at the sound opening. The dust collection pocket may be substantially acoustically not transparent.

A method may be provided comprising connecting a dust barrier to a housing of an apparatus, where the housing comprises a sound hole through the housing, where the dust barrier comprises a recessed depression to capture dust entering the housing through the sound hole; and locating a sound transducer inside the housing, where the dust barrier is located in a path between the sound hole and the sound transducer. The dust barrier may be configured to accumulate dust therein and prevent dust from passing through the deck at the recessed dust collection pocket. A sound aperture may be formed between the sound hole and the sound transducer such that sound passes by the dust collection pocket between the sound hole and the sound transducer. The dust barrier may form a sound opening between the sound hole and the sound transducer which is offset from the path between the sound hole and the sound transducer to form sound aperture as a tortuous channel between the sound hole and the sound transducer. In one type of embodiment the sound aperture might not be tortuous.

It should be understood that the foregoing description is only illustrative. Various alternatives and modifications can be devised by those skilled in the art. For example, features recited in the various dependent claims could be combined with each other in any suitable combination(s). In addition, features from different embodiments described above could be selectively combined into a new embodiment. Accordingly, the description is intended to embrace all such alternatives, modifications and variances which fall within the scope of the appended claims.

What is claimed is:

1. A portable electronic device comprising:

a housing, where the housing comprises a sound hole;

a speaker comprising a dynamic sound transducer in the housing; and a dust barrier in the housing located between the sound hole and the dynamic sound transducer, where the dust barrier comprises a deck located in a path between the sound hole and the dynamic sound transducer, where the deck comprises a dust collection pocket configured to accumulate dust therein and prevent dust from passing through the deck at the dust collection pocket, where a sound aperture is provided between the sound hole and the dynamic sound transducer such that sound passes by the dust collection pocket between the sound hole and the dynamic sound transducer.

2. A portable electronic device as in claim 1 where the dust collection pocket is in the path and directly behind the sound hole.

3. A portable electronic device as in claim 1 where the deck comprises a sound opening through the deck as part of the sound aperture, where the sound opening is a sole sound opening through the deck.

4. A portable electronic device as in claim 1 where a portion of the deck, which forms a portion of the pocket, is located in a recess into an inner side of the housing.

5. A portable electronic device as in claim 1 where the deck comprises an outer portion connected to an inner side of the housing and an inner portion, where the inner portion forms a portion of the pocket and extends towards the housing past the outer portion.

6. A portable electronic device as in claim 1 where the housing comprises multiple ones of the sound hole, where the sound aperture extends through the deck in an area generally between the sound holes.

7. A portable electronic device as in claim 1 where the sound aperture extends through a middle area of the deck.

8. A portable electronic device as in claim 7 where the pocket comprises at least one pocket on opposite sides of the sound aperture.

9. A portable electronic device as in claim 7 where the deck comprises an outer portion connected to an inner side of the housing and an inner portion which extends towards the housing past the outer portion, where the inner portion of the deck is located in a recess into an inner side of the housing.

10. A portable electronic device as in claim 1 further comprising means for magnetically attracting dust into the pocket.

11. A portable electronic device as in claim 1 where the deck forms a sound opening located in the sound aperture between the sound hole and the sound transducer which is offset from the path to form a tortuous sound aperture between the sound hole and the sound transducer.

12. A portable electronic device as in claim 1 where the deck forms a sound opening located in the sound aperture between the sound hole and the sound transducer, where the deck is solid such that sound does not substantially pass through the deck except at the sound opening.

13. A portable electronic device as in claim 1 where the dust collection pocket is substantially acoustically not transparent.

14. A portable electronic device as in claim 1 where the dust collection pocket comprises a recessed pocket in the dust barrier.

15. A portable electronic device comprising:

a housing, where the housing comprises a sound hole;

a speaker comprising a dynamic sound transducer in the housing, where the dynamic sound transducer comprises a permanent magnet; and a magnetic dust collection system for collecting dust which enters the sound hole, where the magnetic dust collection system is configured to prevent the dust from reaching the dynamic sound transducer, where the magnetic dust collection system is located between the sound hole and the dynamic sound transducer and comprises a dust barrier, where a magnetic field of the permanent magnet is orientated across a sound aperture, formed by the housing and the dust barrier, to magnetically pull dust against the dust barrier.

16. A portable electronic device as in claim 15 where the dust barrier comprises a substantially solid deck located in a path directly between the sound hole and the sound transducer.

17. A portable electronic device as in claim 16 where the dust barrier comprises a dust collection pocket directly behind the sound hole.

18. A portable electronic device as in claim 17 where the deck comprises a sound opening therethrough which is offset from the path to form the sound aperture as a tortuous sound channel between the sound hole and the sound transducer.

19. A portable electronic device as in claim 18 where the sound opening is the sole sound opening through the deck.

20. A portable electronic device as in claim 15 where a portion of the dust barrier is located in a recess into an inner side of the housing.

21. A portable electronic device as in claim 15 where the dust barrier comprises an outer portion connected to an inner side of the housing and an inner portion which extends towards the inner side of the housing past the outer portion.

22. A portable electronic device as in claim 15 where the housing comprises multiple ones of the sound holes, where at least one sound opening in the dust barrier is in an area generally between the sound holes.

23. A portable electronic device as in claim 15 where the dust barrier has a sound opening therethrough which is in a middle area of the dust barrier.

24. A method comprising:

connecting a dust barrier to a housing of a portable electronic device, where the housing comprises a sound hole through the housing, where the dust barrier comprises a dust collection pocket to capture dust entering the housing through the sound hole; and locating a dynamic sound transducer of a speaker inside the housing, where the dust barrier is located in a path between the sound hole and the dynamic sound transducer, where the dust barrier is configured to accumulate dust therein and prevent dust from passing through a deck at the dust collection pocket, where a sound aperture is formed between the sound hole and the dynamic sound transducer such that sound passes by the dust collection pocket between the sound hole and the sound transducer.

25. A method as in claim 24 where the dust barrier forms a sound opening as part of the sound aperture between the sound hole and the sound transducer, where the sound opening is offset from the path between the sound hole and the sound transducer to form a tortuous sound channel between the sound hole and the sound transducer.

26. A portable electronic device as in claim 1 where the dust collection pocket comprises a pool with pool edge walls on opposite sides of the pool.

27. A portable electronic device as in claim 1 where the dust collection pocket comprises a lower surface and relatively higher upper surfaces on opposite sides of the lower surface, where the sound aperture is spaced from the dust collection pocket.

28. A portable electronic device as in claim 15 where the dust barrier comprises a dust collection pool having raised pool edge walls on opposite sides of the pool.

29. A portable electronic device as in claim 15 where the dust barrier comprises a dust collection pool comprising a lower surface and relatively higher upper surfaces on opposite sides of the lower surface, where the sound aperture is spaced from the dust collection pool.

30. A method as in claim 24 where the dust collection pocket is provided as a pool having raised pool edge walls on opposite sides of the pool.

* * * * *